US005124223A

United States Patent [19]

Yoerger

[11] Patent Number: 5,124,223

[45] Date of Patent: Jun. 23, 1992

[54] MAGNETIC CARRIER CORES COATED WITH PERFLUORINATED WERNER COMPLEXES AND DEVELOPERS CONTAINING THE SAME

[75] Inventor: William E. Yoerger, Rochester, N.Y.

[73] Assignee: Eastman Kodak Company, Rochester, N.Y.

[21] Appl. No.: 609,275

[22] Filed: Nov. 5, 1990

Related U.S. Application Data

[63] Continuation-in-part of Ser. No. 432,019, Nov. 6, 1989, abandoned.

[51] Int. Cl.[5] ..... G03G 9/10

[52] U.S. Cl. ..... 430/106.6; 430/108

[58] Field of Search ..... 430/106.6, 108

[56] References Cited

U.S. PATENT DOCUMENTS 4,355,087 10/1982 Martin ..... 430/274

4,524,119 6/1985 Luly et al. ..... 428/404

*Primary Examiner*—Marion E. McCamish

*Assistant Examiner*—S. Rosasco

*Attorney, Agent, or Firm*—Dressler, Goldsmith, Shore, Sutker & Milnamow, Ltd.

[57] ABSTRACT

Magnetic carrier core particles are provided which are coated with a Werner complex. The coating is readily accomplished by dispersing magnetic core particles in a solution of the Werner type complex. A hydroxyl group containing polymer can also be present which functions to enhance coating thickness. The Werner complexes are highly reactive, bond strongly to hydroxyl groups, and absorb readily into the core particles. Coated particles display excellent useful life capability and developer compositions containing such coated cores produce high resolution developed images.

8 Claims, No Drawings

MAGNETIC CARRIER CORES COATED WITH PERFLUORINATED WERNER COMPLEXES AND DEVELOPERS CONTAINING THE SAME

CROSS REFERENCE TO RELATED APPLICATION

This application is a continuation-in-part of U.S. Ser. No. 07/432,019, filed Nov. 6, 1989, now abandoned.

FIELD OF THE INVENTION

This invention is in the field of coated magnetic carrier core particles for incorporation with toner powders into developers.

BACKGROUND OF THE INVENTION

Japanese Patent Publication J5 8068-754 discloses very small magnetic powders (0.1-5$\mu$) that are dispersed within toner particles to give the particles magnetic properties. A Werner type chromium complex of the formula:

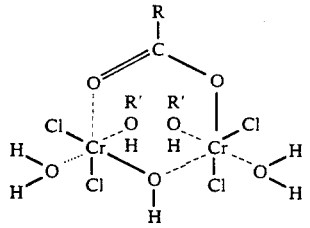

I wherein

R is a residue of a compound of the formula $C_nH_{2n+1}COOH$;

$R^1$ is a residue of $C_3H_7OH$; and n is an integer of 14 through 18 is used as a coupling agent to treat the magnetic powder so that it disperses in the toner polymer.

SUMMARY OF THE INVENTION

This invention is directed to improved magnetic carrier core particles that are coated with a Werner type complex wherein a perfluorinated long chain carboxylic acid and a lower alkanol are coordinated with chromium, and to developer compositions incorporating such coated carrier core particles.

More particularly, a Werner type chromium complex employed in the practice of this invention is characterized by the formula:

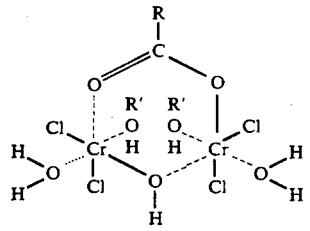

II wherein:

R is a perfluorinated alkyl radical containing 3 through 20 carbon atoms; and $R^1$ is a lower alkyl radical.

The Werner type complexes of Formula II are highly reactive so that they bond strongly to hydroxyl (—OH) groups and/or are readily absorbed into the surface of carrier core particles. They cause carrier core particles coated therewith to be negatively charged.

Carrier core particles are readily coated with compounds of Formula II, and the core particles so coated display long useful life. They are readily blendable with toner powder components to provide toner powder compositions with excellent performance characteristics. For example, the toner powder compositions provide high quality, high resolution developed images.

Other and further advantages, aims, features and the like will be apparent to those skilled in the art when taken with the appended claims.

DETAILED DESCRIPTION

As used herein, the term "lower" used before a group term, such as "alkyl", has reference to such a group which contains less than 7 carbon atoms, and which can be a branched or a straight chain when more than 3 consecutive carbon atoms are present in such group.

As used herein, the term "perfluorinated" used before a group term, such as "alkyl", has reference to such a group wherein essentially all hydrogen atoms have been replaced by fluorine atoms.

Embodiments of the Werner type chromium complexes of Formula II are available commercially from 3M Company of St. Paul, Minn. Such complexes are sold by 3M Co. as water and oil repellant treatments for paper (for example, Scotchban TM FC805) and as leather surface treatments (for example, Scotchban TM FC236A). Scotchban TM FC805 is a fluoroalkyl carboxylate of trivalent chromium complex.

Magnetic carrier core particles suitable for use as starting materials in the practice of this invention typically have average particle diameters in the range of about 10 to about 150 microns, and preferably about 10 to about 35 microns. Examples of suitable carrier core particles include magnetite, ferrite, ferromagnetic alloys, and the like, with a present preference being ferrite. Such carrier core particles and methods for their preparation are known to the art.

Coating of a group of individual particles of carrier core particles with a Formula II complex can be carried out by any convenient procedure. One convenient and presently preferred procedure involves dispersing with agitation carrier core particles in a lower alkanol (preferably isopropanol) solution of a Formula II Werner type complex. The concentration of Formula II Werner type complex in such solvent can be in the range of about 1 to about 100 grams per liter while the quantity of such particulate carrier core particles dispersed in such solvent can be in the range of about 200 to about 800 grams per liter. Ambient temperatures, and short contacting times which can be in the range of about 10 to about 120 minutes, can be used.

Thereafter, the resulting dispersion is filtered to separate the coated carrier core particles which are then dried and cured. For example, they can be dried and concurrently cured by being heated in air at a temperature in the range of about 60° C. to about 100° C. for a time in the range of about 1 to about 4 hours.

The quantity of Formula II Werner type complex coated upon carrier core particles is typically in the range of about 0.7 to about 10 parts by weight per 100 parts by weight of carrier core particles, and preferably is in the range of about 1 to about 4 parts by weight per 100 parts by weight of carrier core particles.

In an alternative coating procedure, an hydroxyl group containing polymer is dissolved in the solution of Formula II Werner type complex. Examples of suitable polymers include ethyl cellulose and the like. The quantity of such polymer so dissolved can be in the range of about 1 to about 60 grams per liter of solvent. Dispersing of carrier core particles in the solvent medium is then carried out as above described, followed by separation and curing of coated carrier core particles as above described.

A Werner type complex of Formula II not only bonds to the carrier core particles, but also to the polymer which is thereby cross-linked. When such a polymer is employed, thicker coatings on carrier core particles can be achieved. The Werner complex of Formula II is reactive with the —OH groups on the ferrite or on the polymer itself. It, therefore, forms a new organometallic fluorinated polymer coating on the carrier surface. For example, in such procedure, the quantity of Formula II Werner type complex so coated upon carrier core particles can be within the range of about 3 to about 10 parts by weight per 100 parts by weight of carrier core particles, although higher and lower coating weights can be achieved, if desired. The quantity of such polymer when employed can be in the range of from 0 to about 15 parts by weight per 100 parts by weight of carrier core particles, and preferably is in the range of about 0.1 to about 1.0 part by weight per 100 parts by weight of carrier core particles.

When the magnetic coated carrier core particles are blended with toner particles small amounts of other additives may also be present and are incorporated using conventional mechanical blending procedures. Such coated carrier core particles provide desired triboelectric properties to a toner particle composition.

Regulation and controlled variation of the charge associated with the coated carrier core particles can be achieved by various means. For example, a Werner-type complex of Formula II can be admixed with a Werner-type complex of Formula I. Preferably, the total amount of Formula I Werner type complex material employed is not more than about 80 weight percent to the total weight percent of all Werner type complex materials of Formulas I and II present in a coating dispersion.

If desired, the coated carrier core particles can be used in a composition of toner particles in combination with magnetic carrier core particles. Examples of suitable magnetic carrier core particles are disclosed in U.S. Pat. Nos. 3,795,617; 3,795,618; 4,076,859; and 4,546,060.

Usually the total quantity of coated magnetic carrier core particles incorporated into a toner composition is in the range of about 70 to about 99.9 weight percent. Correspondingly such composition also contains about 0.1 to about 30 weight percent of heat fusible, colorant-containing toner particles. As those skilled in the art will appreciate, other additives may also be present in a toner composition, as for example, pigments, charge control agents, stabilizing agents, waxes, low surface energy liquids such as are described in U.S. Pat. No. 4,517,272, and the like. Usually, the total quantity of all additives is below about 20 weight percent of the toner composition on a total toner composition weight basis, and preferably is below about 10 weight percent thereof.

Suitable prior art colorants, including publications; see, for example, U.S. Pat. Nos. 140,644; 4,416,965; 4,414,152; and 2,229,513. The amount of colorant incorporated into toner particles can vary widely. For example, the amount incorporated can be in the range of about 0.5 to about 20 weight percent with a range of about 1 to about 6 weight percent being presently preferred, on a total toner powder composition weight basis.

Heat fusible polymers employed in toner powder particles are preferably solvent soluble, and preferably have an intrinsic viscosity (i.v.) in the range of about 0.07 to about 0.7 as measured in methylene chloride solution at a concentration of 0.25 grams of polymer per 100 milliliters of such solution.

Also, such polymers have fusing points preferably in the range of about 65 to about 200° C. The term "fusing point" as used herein refers to the melting point of a resin as measured by a Fisher Johns apparatus, Fisher Scientific Catalog no. 12-144 or equivalent.

Further, such polymers have a glass transition temperature ($T_g$) which is preferably in the range of about 50 to 120° C. The term "glass transition temperature" ($T_g$) as used herein refers to the temperature at which a polymer material changes from a glassy polymer to a rubbery polymer. This temperature ($T_g$) can be measured by differential thermal analysis as disclosed in "Techniques and Methods of Polymer Evaluation", Vol. 1, Marcel Dekker, Inc., N.Y. 1966.

Suitable such polymers can have various chemical structures. For example, they can be selected from among polyesters, polyesteramides, polycarbonates, polyolefins, polyacrylics, polystyrene and styrene copolymers, and the like. Presently preferred polymers are polyesters, polyesteramides and styrene-acrylic copolymers.

Any convenient or known procedure can be used for preparing toner powders; such procedures are generally known to the prior art. For example, a suitable solid polymer, such as a polyester, polyesteramide, or the like can be melt blended with colorant (pigment or dye) and other desired or optional additives. For example, a melt blending procedure can be employed using heated compounding rolls, or the like. This is crushed, then coarsely ground, then passed through a fine grinding apparatus, such as a fluid energy or air jet mill such as taught in U.S. Pat. No. 4,089,472.

The particle size of toner powder particles can vary widely, but usually is in the size range of about 0.5 to about 50 microns in average diameter. Choice of particle size is influenced by the particular magnetic toner powder development process contemplated Toner particles in the size range of about 1 to about 30 microns in average diameter are presently preferred and are useful, for example, in the so called magnetic brush development process, or the like.

The invention is illustrated by the following examples

EXAMPLE 1

Coated Carrier Core Particle Preparation 20 grams of hard ferrite is dispersed in, and stirred for one-half hour in, 66 cubic centimeters of a 1% solution (by weight in isopropanol) of a Formula II Werner type chromium complex.

The hard ferrite was a strontium ferrite

The Werner type chromium complex was Scotchban TM FC805 obtained from 3M Co., St. Paul, Minn.

The resulting dispersion was then filtered on a Buchner funnel, air dried, and finally vacuum oven dried under a light negative pressure for two hours at 60° C.

EXAMPLE 2

Coated Carrier Core Particle Preparation

The procedure of Example 1 was repeated except that the Werner-type chromium complex employed was Scotchban TM FC236A obtained from 3M Co., St. Paul, Minn.

EXAMPLE 3

Toner Particle Composition Preparation

Each of the coated ferrite particles of Examples 1 and 2 was blended with each of (a) 10 weight percent (total blend basis) of a cyan polyesteramide toner; and (b) 13 weight percent (total blend basis) of a magenta polyester toner.

In addition, the uncoated ferrite particles such as used in each of Examples 1 and 2 was similarly blended with each of the toners identified as (a) and (b) above.

Also, for comparison purposes coated carrier core particles identified as Kynar TM 301F were similarly blended with each of the toners identified as (a) and (b) above. The carrier contained 1 part by weight Kynar TM per 100 parts by weight of carrier.

Kynar TM 301F particles are polyvinylidene fluorine coated core particles.

The 30 second (fresh and 5 minute exercised) charge was measured for each formulation by a procedure in which the separation of toner and carrier is accomplished through the combined action of magnetic agitation of the developer and electric field. The developer is charged by shaking it in a mechanical shaker for 150 sec and from 0.1 to 1 g are placed in a sample dish. An AC magnetic field (60 Hz) and an electric field of −2000 V/cm are then applied for 30 sec. Toner is released from the carrier by the mechanical agitation of the developer caused by the magnetic filed and transported to the upper plate by the electric field. The charge on the toner is recorded with an electrometer and the weight of the toner collected on the plate is determined. Toner charge-to-mass is calculated by dividing the charge by the mass of the toner.

The sample was exercised for 5 minutes by placing 1 g of developer in a 4 dram glass, screw cap, vial and holding it in a stationary position over the shell of a magnetic brush. The core only is then rotated (−2000 RPM's) for 5 minutes. Thus causing the developer above to experience severe magnetic agitation. The results are shown in Table I below.

TABLE I

| | | 30 Second Charge Measurements | | | |
|---|---|---|---|---|---|
| | | Cyan Polyesteramide Toner | | Magenta Polyester Toner | |
| Ex. No. | Core Particles | Fresh | 5 Min. Ex. | Fresh | 5 Min. Ex. |
| 3.1 | Uncoated Ferrite | −25.8 | −47.9 | 1.8 | 3.9 |
| 3.2 | Ex. 1 Coated Ferrite | 44.2 | 52.3 | 26.0 | 23.2 |
| 3.3 | Ex. 2 Coated Ferrite | 41.7 | 51.1 | 28.9 | 22.7 |
| 3.4 | Kynar TM 301F | 90.9 | 14.6 | 64.8 | 23.8 |

The data in Table I shows that the developer compositions prepared with coated carrier core particles of the invention have charge values intermediate between uncoated ferrite particles and Kynar TM 301F particles.

The data in Table I also shows that the developer compositions prepared with carrier core particles of this invention exhibit only a small change in charge values between fresh and 5 minute exercised values, thus showing good charge stability with time.

EXAMPLE 4

Imaging

Using the developer compositions prepared as in Example 3 (above), latent electrostatic images are formed by conventional electrophotographic methods and then developed using a magnetic brush.

It is found that developed electrophotographic images made with developer compositions of Examples 3.2 and 3.3 (above) exhibited high quality and resolution.

The invention has been described in detail with particular reference to preferred embodiments thereof, but it will be understood that variations and modifications can be effected within the spirit and scope of the invention.

I claim:

1. Magnetic carrier core particles coated with a Werner type complex wherein a perfluorinated long chain carboxylic acid and a lower alkanol are complexed with chromium.

2. The coated carrier core particles of claim 1 wherein the coating additionally contains an hydroxyl group containing polymer.

3. The coated carrier particles of claim 1 wherein said particles have average diameters in the range of about 10 to about 150 microns, the quantity of said Werner types complex is in the range of about 0.1 to about 15 parts by weight per 100 parts by weight of additionally contains from and including 0 to about 15 parts by weight of an hydroxyl group containing polymer per 100 parts by weight of said carrier core particles.

4. The coated carrier core particles of claim 1 wherein said Werner type complex is characterized by the formula:

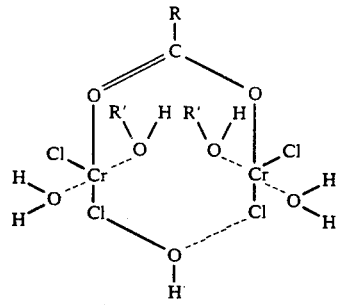

wherein:

R is a perfluorinated alkyl radical containing 3 through 20 carbon atoms and $R^1$ is a lower alkyl radical.

5. A developer composition comprising on a 100 weight percent total composition weight basis:

about 70 to about 99.9 weight percent of magnetic carrier core particles coated with a Werner type complex of claim 4; and about 0.1 to about 30 weight percent of heat fusible toner particles.

6. The developer composition of claim 5 wherein said toner particles comprise on a 100 weight percent total toner particles weight basis:

about 70 to about 99.9 weight percent of heat fusible polymer having an intrinsic viscosity in the range of about 0.07 to about 0.7 measured in methylene chloride solution at a concentration of 0.25 grams of polymer per 100 milliliters of such solution, a fusing point within range of about 65 to 200° C., and a glass transition temperature in the range of about 50 to 120° C.;

about 0.5 to about 25 weight percent of a colorant dispersed in said polymer; and about 0.1 to about 6 weight percent of a charge agent developer.

7. The developer composition of claim 5 wherein the coating in said carrier core particles additionally contains an hydroxyl group containing polymer.

8. The developer composition of claim 5 wherein said carrier core particles have average diameters in the range of about 10 to about 35 microns, the quantity of said Werner complex is in the range of about 0.1 to about 15 parts by weight per 100 parts by weight of said carrier core particles, and the coating on said carrier core particles additionally contains from 0 to about 15 parts by weight of an hydroxyl group containing polymer per 100 parts by weight of said carrier core particles.

* * * * *